US009185480B2

(12) United States Patent
Howes et al.

(10) Patent No.: US 9,185,480 B2
(45) Date of Patent: Nov. 10, 2015

(54) ACOUSTICALLY ACTUATED MECHANICAL VALVE FOR ACOUSTIC TRANSDUCER PROTECTION

(71) Applicant: Apple Inc., Cupertino, CA (US)

(72) Inventors: Michael B. Howes, Mountain View, CA (US); Kurt R. Stiehl, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 346 days.

(21) Appl. No.: 13/716,015

(22) Filed: Dec. 14, 2012

(65) Prior Publication Data

US 2014/0169585 A1 Jun. 19, 2014

(51) Int. Cl.
*H04R 1/02* (2006.01)
*H04R 1/08* (2006.01)

(52) U.S. Cl.
CPC ..... *H04R 1/086* (2013.01); *H04R 2420/07* (2013.01)

(58) Field of Classification Search
CPC ..... H04R 1/10; H04R 2460/15; H04R 13/00; H04R 15/00; H04R 1/04; H04R 1/08; H04R 1/083; H04R 1/086; H04R 1/1008; H04R 1/1041; H04R 1/2803; H04R 1/38; H04R 2225/61; H04R 2420/07; H04R 2460/11; H04R 25/402; H04R 25/606; H04R 25/658; H04R 1/025; H04R 9/08; H04R 25/65; H04R 5/02; H04R 3/005; H04R 19/04; H04R 1/406; H04R 3/00; H04R 1/26; H04R 3/007; H04R 3/04; H04R 31/006; H04R 11/00; G10K 11/1788
USPC ..... 381/386–387, 176, 322, 361, 91, 304, 381/112–115, 332, 355, 336, 55, 71.7, 94.9, 381/150, 162, 163, 26, 92, 95, 110–115, 381/122, 151, 369, 175, 375
See application file for complete search history.

(56) References Cited

U.S. PATENT DOCUMENTS

| | | | | |
|---|---|---|---|---|
| 4,817,168 | A * | 3/1989 | Fidi | 381/357 |
| 6,466,681 | B1 | 10/2002 | Siska, Jr. et al. | |
| 7,861,723 | B2 | 1/2011 | Dedrick et al. | |
| 8,113,482 | B2 | 2/2012 | Hunnicutt | |
| 8,798,304 | B2 * | 8/2014 | Miller et al. | 381/356 |
| 2007/0040231 | A1 | 2/2007 | Harney et al. | |
| 2009/0226023 | A1 * | 9/2009 | Akino | 381/374 |
| 2011/0110550 | A1 * | 5/2011 | Bharatan et al. | 381/355 |
| 2011/0261986 | A1 * | 10/2011 | Murayama | 381/332 |
| 2014/0133687 | A1 * | 5/2014 | Lee | 381/355 |

FOREIGN PATENT DOCUMENTS

| | | |
|---|---|---|
| CN | 202178856 | 3/2012 |
| JP | 2009302800 | 12/2009 |

* cited by examiner

*Primary Examiner* — Akelaw Teshale
(74) *Attorney, Agent, or Firm* — Blakely, Sokoloff, Taylor & Zafman LLP

(57) ABSTRACT

A portable electronic device including an outer case having a wall in which a transducer-associated acoustic hole is formed. An inner case may be positioned inside the outer case. The inner case can include an acoustic port that opens to the transducer-associated acoustic hole and a relief port that opens to the outer case. A transducer having a diaphragm facing the acoustic port of the inner case is mounted within the inner case. A valve is further positioned over the relief port. The valve is configured to reduce an impact of an incoming air burst on the diaphragm.

12 Claims, 11 Drawing Sheets

ACOUSTICALLY ACTUATED MECHANICAL VALVE FOR ACOUSTIC TRANSDUCER PROTECTION

FIELD

An embodiment of the invention is directed to an acoustic transducer having a valve to protect against acoustic shock, more specifically a microphone with a mechanical valve to protect against a sudden air burst. Other embodiments are also described and claimed.

BACKGROUND

Cellular telephone handsets and smart phone handsets have within them a microphone that converts input sound pressure waves produced by the user speaking into the handset, into an output electrical audio signal. The handset typically has a housing with an opening through which incoming sound pressure waves created by the user's voice can reach the microphone. This opening, however, can also allow for entry of rapid air bursts when, for example, the phone unintentionally and forcefully collides with a flat surface or a user tries to clean the device with a high pressure air flow. If these rapid air bursts reach the microphone, the transducer experiences a sudden acoustic shock that, in some cases, can damage a flexible diaphragm and/or a rigid back plate, found within certain microphones, which are not designed to withstand such a force.

SUMMARY

An embodiment of the invention is a portable electronic device having an outer case with at least one wall in which a transducer-associated acoustic port (the transducer to be installed inside the outer case) is formed. In some embodiments, the transducer may be a microphone, such as a micro-electro-mechanical systems (MEMS) microphone. The MEMS microphone may include various components, for example a pressure sensitive diaphragm, which are sensitive to a sudden acoustic shock, such as one that may be directed into the case through the acoustic port when the device experiences a sudden, forceful collision with a flat surface on the side having the acoustic port. In this aspect, the invention further includes a valve positioned over a relief port formed within an inner case containing the transducer. The valve may be configured to reduce an impact of the incoming air burst on the diaphragm of the transducer. In some embodiments, the valve may be a pressure sensitive valve capable of transitioning between a closed position and an open position in response to a pressure change within the inner case. In other embodiments, the valve may be a piezoelectric valve capable of transitioning between a closed position and an open position in response to a pressure change on the diaphragm. In still further embodiments, the valve may be a magnetic valve capable of transitioning between a closed position and an open position in response to a momentum force, which occurs when the device is dropped and/or collides with a hard surface.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
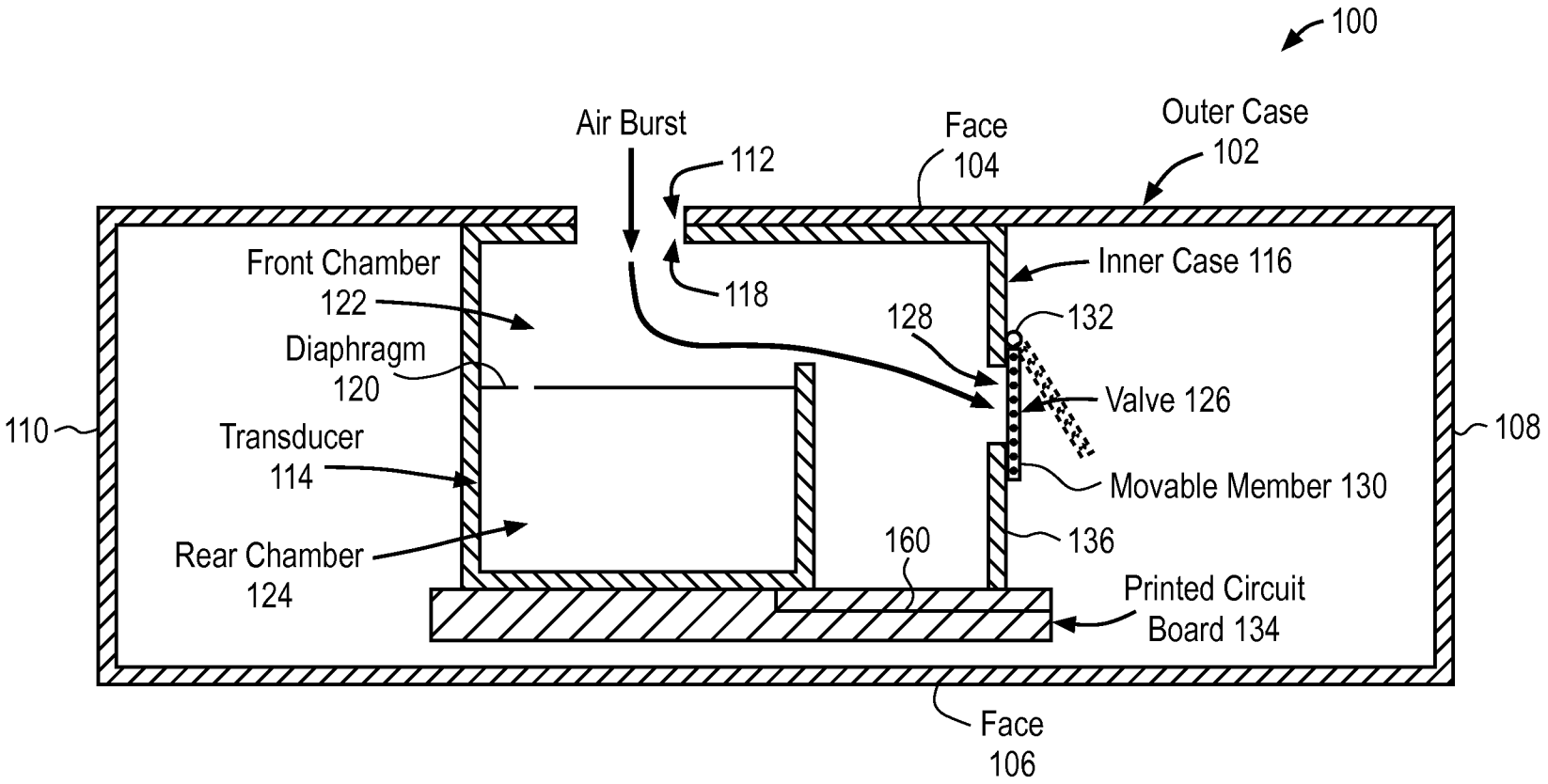
FIG. 1 illustrates a cross-sectional side view of one embodiment of a transducer having a valve to protect against a sudden air burst.

FIG. 1 illustrates a cross-sectional side view of one embodiment of a valve for protecting a transducer within an electronic device. Outer housing or case 102 may define or close off a chamber in which the constituent electronic components of electronic device 100, for example a mobile communications device, are contained. Outer case 102 may therefore include a face 104 (e.g., a front face), a face 106 (e.g., a back face) and side walls 108, 110 connecting face 104 to face 106. An acoustic hole 112 may be formed within any one or more of face 104, face 106 or side walls 108, 110 and may be dimensioned to provide an acoustic input or output to or from electronic device 100. In this case, acoustic hole 112 may be a transducer-associated acoustic hole which is acoustically coupled to transducer 114 contained within outer case 102.

In one embodiment, transducer 114 may be a microphone, such as a MEMS microphone, a condenser microphone or any other variant of a condenser microphone, which is contained within an inner case 116 mounted within outer case 102. Inner case 116 may include an acoustic port 118 aligned with acoustic hole 112 such that, in the case of a microphone, a sound external to outer case 102 (e.g., a user's voice) can travel through outer case 102 and inner case 116 to transducer 114. Transducer 114 may include a pressure-sensitive diaphragm 120 which vibrates in response to the externally generated sound waves. These vibrations are then converted into electrical current by transducer 114, which in turn become the audio signal (e.g., audio signal within a frequency range of from about 20 Hz to about 20 kHz) that can be transmitted to, for example, a far end user in the case of a communications device or audio/video recording device. In this aspect, transducer 114 may include or be associated with processing components such as circuitry (which has been omitted for clarity) and may be electrically connected to printed circuit board 134 by, for example wiring or surface mount technology 160, to facilitate its operation.

In some embodiments, diaphragm 120 may divide inner case 116 into a front chamber 122 which is acoustically coupled to one face of diaphragm 120 and a rear chamber 124 which is acoustically coupled to the other face of diaphragm 120. Rear chamber 124 may be substantially acoustically sealed from front chamber 122 and define a substantially confined volume of air. As a result, a pressure increase on diaphragm 120 may, in some cases, increase a pressure within rear chamber 124 and thereby create a more compressed volume of air behind diaphragm 120. When this pressure increase is due to a sudden acoustic shock, for example, an impulsive air burst, diaphragm 120 may be damaged. Such damage may occur, for example, as a result of the air pressure or force on diaphragm 120 and/or because the diaphragm 120 cannot flex due to the compressed air volume behind it to facilitate its response. Such an air burst may occur when, for example, device 100 collides forcefully with a substantially flat surface or a user tries to clean the device with a compressed air duster. A pressure from such an air burst is particularly problematic with respect to transducers associated with ports on the substantially planar faces (e.g., face 104 and face 106) of device 100. For example, when device 100 experiences a collision with a flat surface on face 104 or face 106, the air pressure builds up as the device meets the surface with which it is colliding and cannot easily escape around the sides of device 100. Some of the air is therefore forced into the ports, such as acoustic hole 112, depending upon which side of device 100 impacts the surface. This rapid burst of air can, in turn, rapidly increase a pressure and/or air flow on the associated diaphragm (and in some cases a sealed volume of air behind the diaphragm) and damage the diaphragm, and/or other components within the transducer, particularly MEMS microphone components. It is noted that the terms "air burst," "rapid air burst" and "impulsive air burst" may be used interchangeably herein and should be understood as referring to a type of sudden acoustic shock caused by a burst of air which occurs suddenly and has a particle velocity sufficient to damage an unprotected transducer diaphragm. Thus, an "air burst" should be understood as having both a pressure and a particle velocity higher than, for example, that which would be produced by a user speaking into the device.

In order to protect the transducer 114 (e.g., MEMS microphone), particularly diaphragm 120, from such air bursts, valve 126 can be co-located near the diaphragm 120 so that the burst of high pressure air follows the path of least resistance, i.e., through the opened valve 126 thus reducing a pressure on diaphragm 120 and/or within inner case 116. In one embodiment, valve 126 is a mechanical valve positioned over a relief port 128 formed through a wall of inner case 116. In the illustrated embodiment, relief port 128 is formed within a side wall 136 of inner case 116 which forms part of front chamber 122. It is contemplated, however, that relief port 128 may be formed within any of the walls of inner case 116 defining front chamber 122. Still further, in embodiments where transducer 114 is a MEMS microphone, valve 126 may be integrally formed as part of the MEMS device. Valve 126 may be configured to open and/or close in response to a rapid air burst so as to reduce an impact of the air burst on diaphragm 120. For example, in a resting position, valve 126 is closed such that valve 126 forms a substantially air tight seal over relief port 128. In response to an air burst through acoustic opening 112, and in turn a pressure increase within inner case 116 or on diaphragm 120, valve 126 opens (as illustrated in dashed lines) so that the air can escape out relief port 128, and in turn the pressure within inner case 116 and on diaphragm 120 decreases.

In one embodiment, the change (i.e., increase) in pressure and/or air flow pushes valve 126 open. Valve 126 may therefore be any type of pressure sensitive valve capable of remaining closed during normal atmospheric pressure conditions (e.g., pressure levels caused by a user's voice) and opening in response to higher atmospheric pressure bursts (e.g., pressure levels sufficient to cause damage to diaphragm 120). Representatively, in one embodiment, valve 126 may include a movable member 130 and connecting member 132 that movably connects movable member 130 to inner case 116. For example, in one embodiment, movable member 130 is a substantially rigid structure dimensioned to completely cover and form an air tight seal over relief port 128 in the closed position. Representatively, movable member 130 may be a substantially planar, disk or beam shaped structure where relief port 128 is a circular or elongated port, respectively. Connecting member 132 may be a hinge, spring or other similar mechanism that connects to movable member 130 at one end and inner case 116 at another end and allows movable member 130 to transition from the closed position in which relief port 128 is covered to an open configuration in which relief port 128 is uncovered, and vice versa. For example, valve 126 may be a spring beam type mechanism mounted near relief port 128. In still further embodiments, it is contemplated that movable member 130 may be integrally formed as a part of the wall of inner case 116 such that connecting member 132 is simply an articulated region of the inner case wall which allows the movable member 130 to open and close with respect to relief port 128. Alternatively, movable member 130 may be formed by a flexible membrane made for example of a flexible polymer or rubber material which will transition between open and closed positions in response to a pressure change.

Valve 126 may be biased in a closed position and open in response to a predetermined threshold pressure. Valve 126 may be biased in the closed position by, for example, connecting member 132 or formed within the wall of inner case 116 to have a tension which biases it in the closed position. In one embodiment, the predetermined threshold pressure sufficient to open valve 126 may be a pressure greater than a sound pressure capable of being produced under normal circumstances, such as by a user's voice, but less than a pressure level that may cause damage to diaphragm 120. Representatively, the predetermined threshold pressure may be a pressure at least about 1.5 times higher than standard atmospheric pressure, for example, from about 2 to about 4 times higher than standard atmospheric pressure. In this aspect, when a pressure on diaphragm 120 or within inner case 116 is equal or greater than the pressure sufficient to break or otherwise damage diaphragm 120, valve 126 opens so that the pressure can be relieved using relief port 128. Once the pressure drops below the predetermined threshold pressure, valve 126 returns to the closed position.

Figure 2:
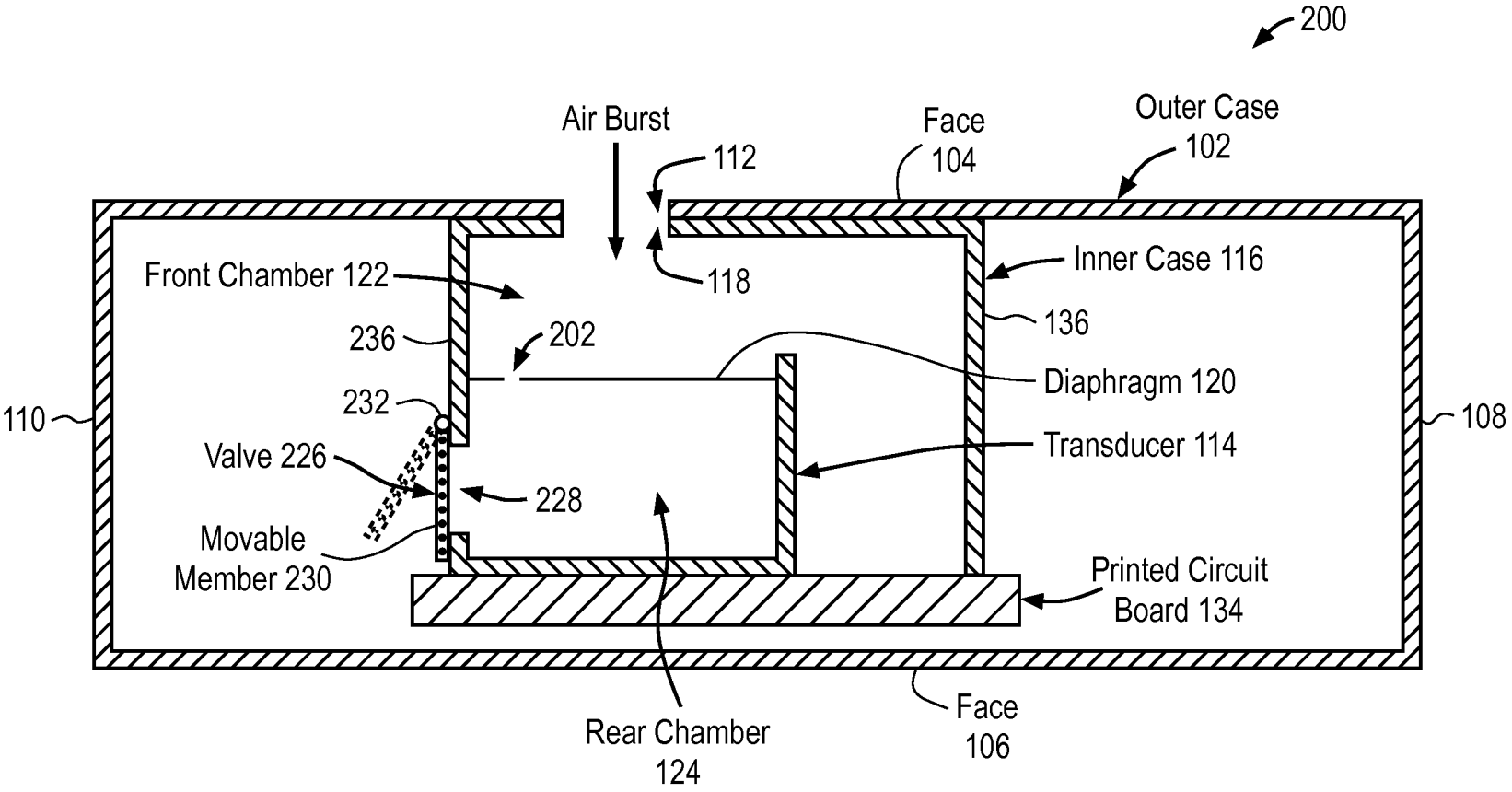
FIG. 2 illustrates a cross-sectional side view of another embodiment of a transducer having a valve to protect against a sudden air burst.

FIG. 2 illustrates a cross-sectional side view of another embodiment of a valve for microphone protection. Each of the components of electronic device 200 are substantially the same as those described in reference to device 100 of FIG. 1, except in this embodiment, relief port 228 is formed within a portion of inner case 116 forming rear chamber 124. Representatively, relief port 228 may be formed within side wall 236, which is opposite side wall 136. As can be seen from FIG. 2, side wall 236 forms a portion of rear chamber 124. Valve 226 includes movable member 230 connected to side wall 236 by connecting member 232. Movable member 230 and connecting member 232 may have any of the previously discussed configurations such that valve 226 is biased in a closed position in the resting state. Similar to the valve of FIG. 1, valve 226 opens in response to a predetermined threshold value. Since in this embodiment, however, valve 226 covers a relief port 228 within rear chamber 124, a threshold pressure within rear chamber 124 triggers valve opening and closing.

As previously discussed, rear chamber 124 is a substantially sealed chamber, with the exception of, in some cases, a small perforation 202 used for pressure equalization or to act as a high pass filter. As such, when an air burst entering through acoustic port 118 applies a pressure force onto diaphragm 120, diaphragm 120 is pushed into rear chamber 124 thus reducing the volume of rear chamber 124, and in turn increasing the pressure within rear chamber 124. This reduction in volume and increase in pressure makes the air volume within the rear chamber 124 less compliant. Such conditions can damage diaphragm 120 since it is no longer free to move in and out of a compliant volume of air. Valve 226, however, is responsive to this change in pressure within rear chamber 124 and opens (as illustrated in dashed lines) when the pressure is above a predetermined threshold value, e.g., a pressure greater than a sound pressure capable of being produced under normal circumstances, such as by a user's voice, but less than a pressure level that may cause damage to diaphragm 120. When valve 226 opens, air within rear chamber 124 vents out of relief port 228 thus lowering the pressure within rear chamber 124. Once the pressure is below the predetermined threshold value, valve 226 closes over relief port 228 in a substantially air tight manner so as not to affect an acoustic performance of transducer 114.

Figure 3:
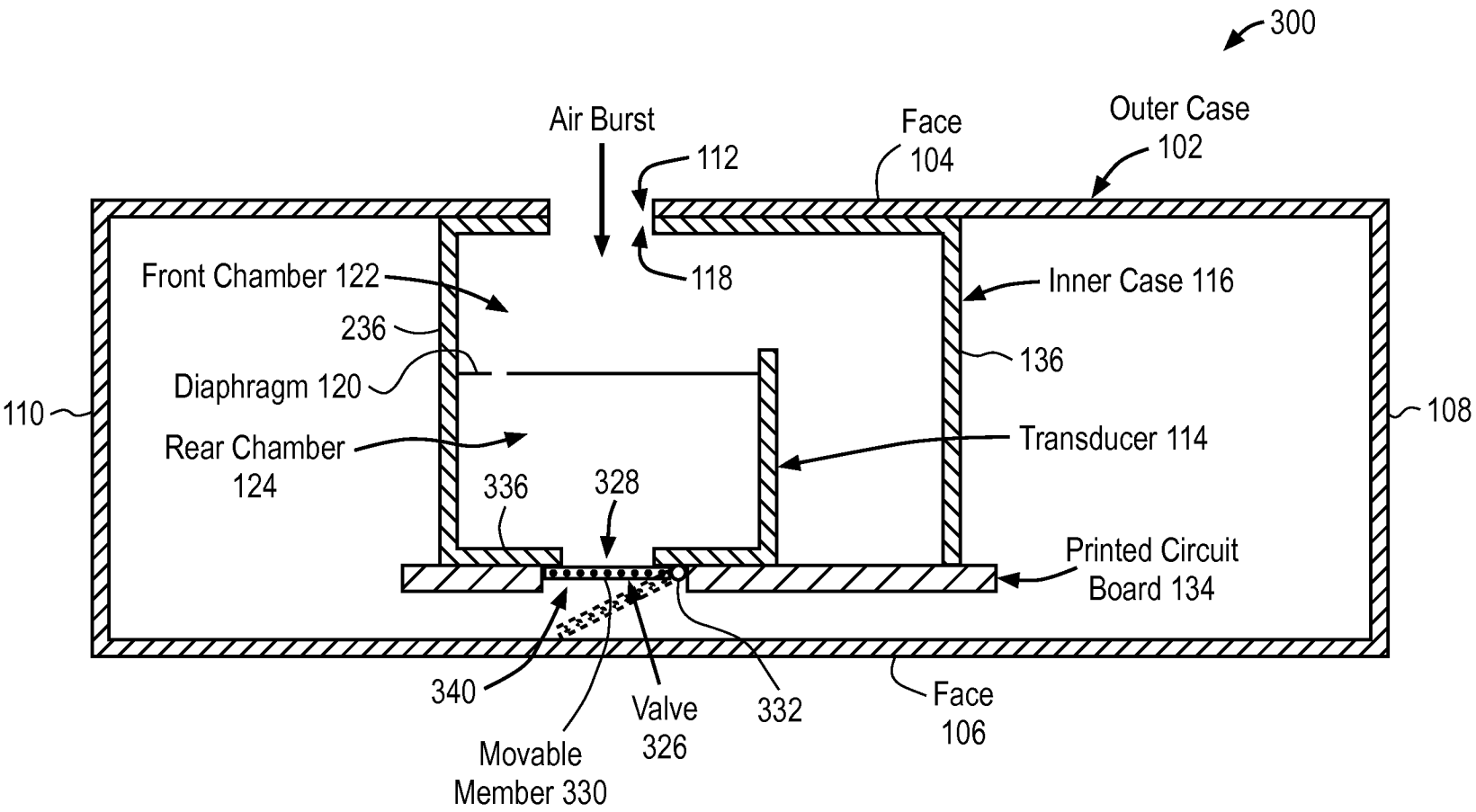
FIG. 3 illustrates a cross-sectional side view of another embodiment of a transducer having a valve to protect against a sudden air burst.

FIG. 3 illustrates a cross-sectional side view of another embodiment of a valve for transducer protection. Each of the components of electronic device 300 are substantially the same as those described in reference to device 100 of FIG. 1 and device 200 of FIG. 2, except in this embodiment, relief port 328 is formed within a bottom wall 336 of inner case 116, which defines a portion of rear chamber 124. Valve 326 includes a movable member 330 and a connecting member 332 which are substantially similar to the previously discussed movable and connecting members. Since in this embodiment, relief port 328 is formed in a side of inner case 116 facing printed circuit board 134, an opening or gap 340 may further be provided within printed circuit board 134 so that air can exit inner case 116 through relief port 328. Similar to valve 226 described in reference to FIG. 2, valve 326 is biased in a closed position by connecting member 332 and opens (as illustrated by dashed lines) when a predetermined threshold pressure value within rear chamber 124 is met or exceeded. Valve 326 in turn closes once the pressure is reduced below the threshold value and forms a substantially air tight seal over relief port 328.

Figure 4A:
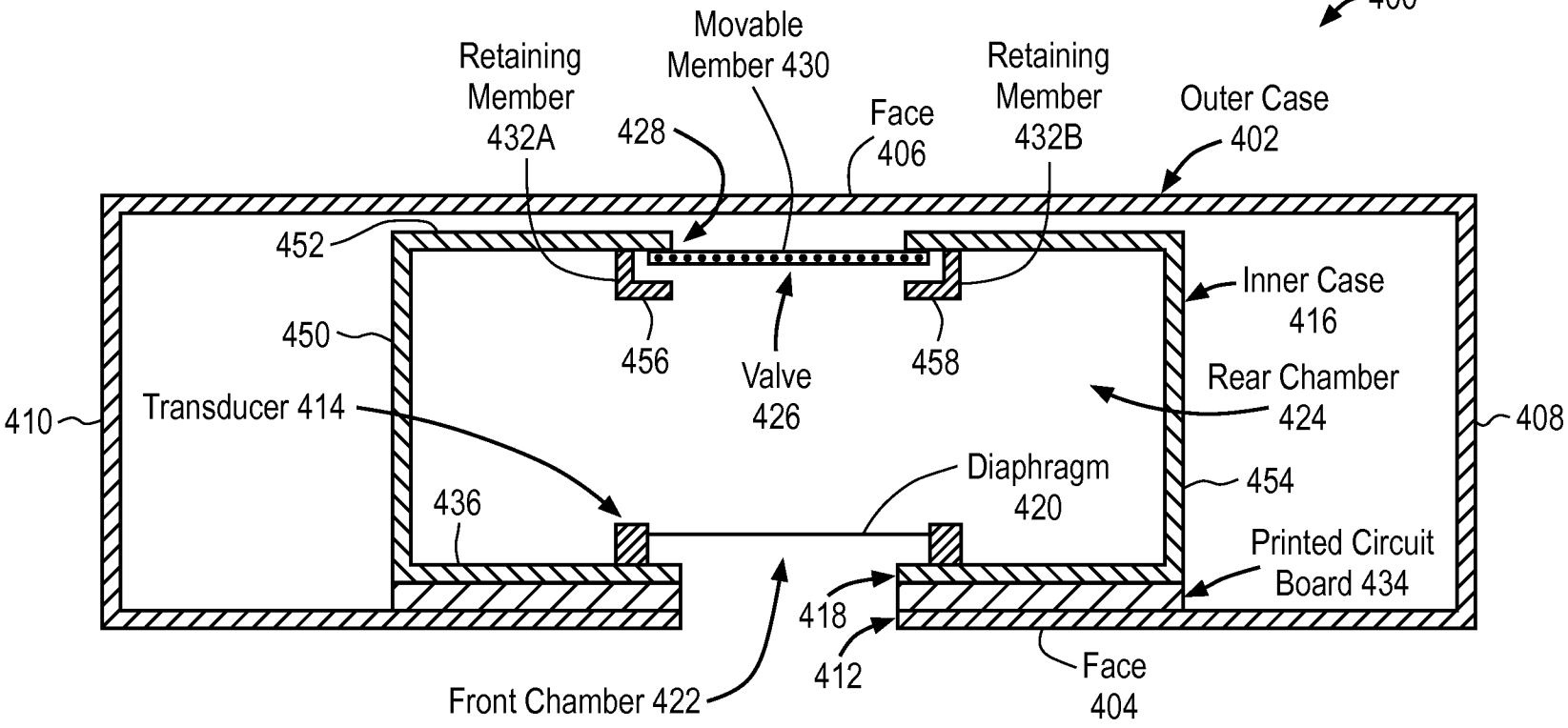
FIG. 4A illustrates a cross-sectional side view of another embodiment of a transducer having a valve to protect against a sudden air burst in a closed position.
Figure 4B:
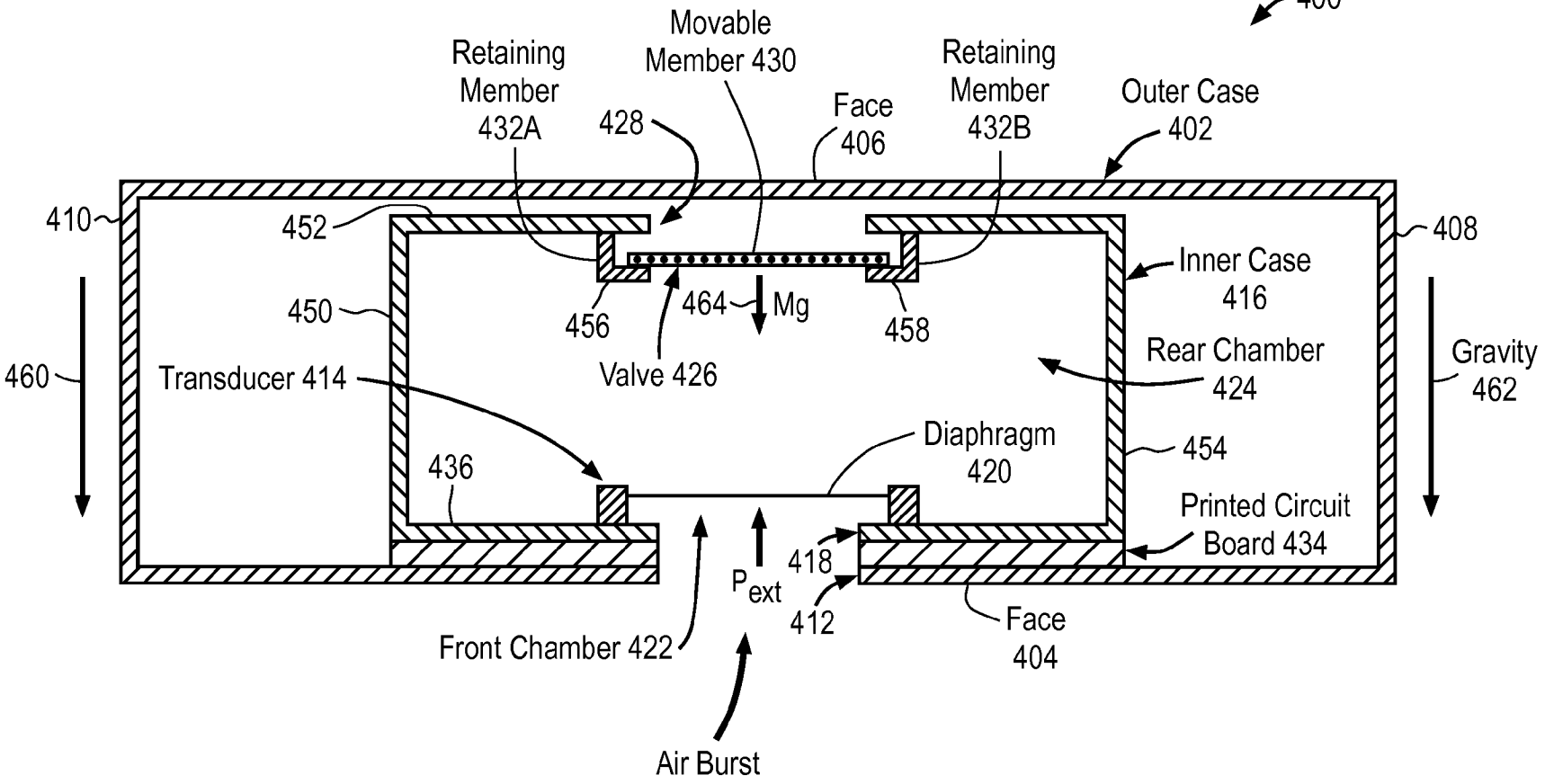
FIG. 4B illustrates a cross-sectional side view of the valve of FIG. 4A in an open position.

FIG. 4A and FIG. 4B illustrate cross-sectional side views of another embodiment of a valve for transducer protection. FIG. 4A illustrates electronic device 400 having valve 426 in a closed position and FIG. 4B illustrates electronic device 400 having valve 426 in an open position. Similar to the previously discussed electronic devices, electronic device 400 includes an outer case 402 dimensioned to contain the various components of the electronic device 400, such as transducer 414 and printed circuit board 434. Outer case 402 may include a face 404 (e.g., a front face), a face 406 (e.g., a back face) and side walls 408 and 410, which connect face 404 to face 406. Transducer 414 may be positioned within an inner case 416, mounted within outer case 402. In one embodiment, transducer 414 may be a microphone such as a MEMS microphone which is contained within inner case 416. In this aspect, transducer 414 may include a pressure-sensitive diaphragm 420 which vibrates in response to the externally generated sound waves. These vibrations are then converted into electrical current by transducer 414, which in turn become the audio signal (e.g., audio signal within a frequency range of from about 20 Hz to about 20 kHz) that can be transmitted to, for example, a far end user in the case of a mobile communications device or to a file such as the case with a video/audio recording. Transducer 414 may include or be associated with processing components such as circuitry (which has been omitted for clarity) and may be electrically connected to printed circuit board 434 to facilitate its operation. Printed circuit board 434, along with transducer 414, may be contained within outer case 102. Inner case 416 may also have faces 436 and 452 which are connected by opposing side walls 450 and 454. Face 404 of outer case 402 may have an acoustic hole 412 aligned with an acoustic port 418 formed within face 436 of inner case 416.

Transducer 414 may be positioned near acoustic port 418 such that transducer 414 can receive sound from, or emit sound to, the ambient environment outside of device 400 through acoustic hole 412. Representatively, in one embodiment, diaphragm 420 of transducer 414 faces acoustic port 418 and acoustic hole 412. Diaphragm 420 may divide inner case 416 into a front chamber 422 which is acoustically coupled to one side of diaphragm 420 and a rear chamber 424, which is acoustically sealed from front chamber 422 and around a back side of diaphragm 420. In embodiments where transducer 414 is a microphone, a sound outside of device 400 (e.g., a user's voice) travels through acoustic hole 412 and acoustic port 418 to transducer 414 where it can be received and converted to an audio signal for transmission to a far end user or other electronic destination.

A relief port 428 may further be formed through inner case 416. Valve 426 is positioned near relief port 428 such that when valve 426 is in a closed position, relief port 428 is covered by valve 426 and when valve 426 is in an open position, relief port 428 is uncovered. In one embodiment, relief port 428 is formed through a portion of inner case 416 defining the rear chamber 424. In this embodiment, valve 426 operates to reduce a pressure within rear chamber 424 which could cause damage to diaphragm 420, or other components of transducer 414. In some embodiments, valve 426 may be a momentum relief mechanism that opens and closes relief port 428 in response to a momentum force on device 400, which is indicative of a pressure increase within rear chamber 424. Representatively, when device 400 unintentionally and forcefully collides with a flat surface in a direction 460, which is the same direction as a gravitational force 462, a burst of air may enter acoustic port 418 and the pressure of this air burst on diaphragm 420 may be sufficient to push diaphragm 420 into rear chamber 424 thereby increasing a pressure within rear chamber 424 and making the air contained therein less compliant. Valve 426 may therefore be configured to open in response to such a momentum force such that the pressure within rear chamber 424 is prevented from reaching a level sufficient to damage diaphragm 420.

In one embodiment, valve 426 may be a magnetic valve assembly which uses a magnetic force to hold itself in a closed position in a resting state but open in response to a momentum force which is indicative of a damaging pressure increase within rear chamber 424. In this aspect, valve 426 may include a movable member 430 which is held in place over relief port 428 using retaining members 432A and 432B. Movable member 430 may be of any size and dimensions sufficient to entirely cover relief port 428. Representatively, movable member 430 may be a substantially planar disk shaped structure having substantially the same shape (e.g., circle, oblong or square shape) as relief port 428. It is contemplated, however, that in other embodiments, movable member 430 may cover less than the entire relief port 428 when in the closed position if desired. Retaining members 432A and 432B may have a substantially "L" shaped profile such that one end can be attached to portions of face 452 of inner case 416 which are near relief port 428 and the other end (e.g., ends 456 and 458) overlaps the edges of movable member 430. The overlapping ends 456 and 458 may be spaced a sufficient distance from the surface of face 452 of inner case 416 such that movable member 430 can move between the surface of face 452 and the interfacing surface of ends 456 and 458. In the closed position, movable member 430 is magnetically attached to the surface of face 452 while in the open position, movable member 430 is separated from face 452 in a direction of retaining members 432A and 432B. It is noted that although substantially "L" shaped retaining members 432A and 432B are described, any mechanism capable of retaining movable member 430 over relief port 428 and allowing movable member 430 to move in response to a momentum force may be used, e.g., a spring mechanism, a hinge assembly or the like.

FIG. 4B illustrates movable member 430 in the open position in which relief port 428 is open so that a pressure within rear chamber 424 can be relieved. The transition of valve 426 from the closed position of FIG. 4A to the open position of FIG. 4B will now be described in more detail. Representatively, movable member 430 may have a predetermined magnetic force ($F_{mag}$) which attracts movable member 430 to the inner surface of face 452 near relief port 428 and therefore holds movable member 430 in the closed position in a resting state. In this aspect, movable member 430 may be a magnet and inner case 416 may be formed from, or have mounted thereto, a material suitable for attracting a magnet, e.g., steel. When device 400 is abruptly moved in a direction of arrow 460, which is the same direction as the gravitational pull 462 on device 400, movable member 430 experiences a momentum force ($M_g$) in a direction 464. A burst of air may also be directed toward diaphragm 420, which causes an external pressure ($P_{ext}$) to be applied to diaphragm 420. This external pressure ($P_{ext}$) may be indicative of a particular momentum force ($M_g$) and vice versa. Thus, in order to open movable member 430 when an external pressure ($P_{ext}$) sufficient to damage diaphragm 420 occurs, movable member 430 may be selected to have a magnetic force ($F_{mag}$) which is less than or equal to a momentum force ($M_g$) which corresponds to the threshold external pressure ($P_{ext}$) sufficient to damage diaphragm 120. In other words, valve 426 will open when $F_{mag} \leq P_{ext} \sim M_g$. Thus, when $M_g$ is greater than or equal to $F_{mag}$, $F_{mag}$ will be insufficient to hold movable member 430 against inner case 416 and movable member 430 will essentially fall toward ends 456 and 458 of retaining members 432A and 432B. This in turn will open relief port 428 as illustrated by FIG. 4B. Since relief port 428 is open, any pressure increase within rear chamber 424 caused by the associated air burst, particularly when device 400 contacts a hard surface below, can be relieved out relief port 428 before damage to diaphragm 420 occurs. Once the force of gravity due to the momentum change ($M_g$) is less than the magnetic force ($F_{mag}$) (e.g., device 400 is no longer moving), the magnetic force ($F_{mag}$) of movable member 430 will pull movable member 430 back against inner case 416 and close and seal relief port 428. It is noted that although a magnetic momentum relief mechanism is described in connection with valve 426, it is contemplated that any type of momentum relief mechanism capable of opening and closing valve 426 in response to a sudden acoustic shock may be used, e.g., a resilient or spring type valve which opens and closes in response to a momentum force.

Figure 5A:
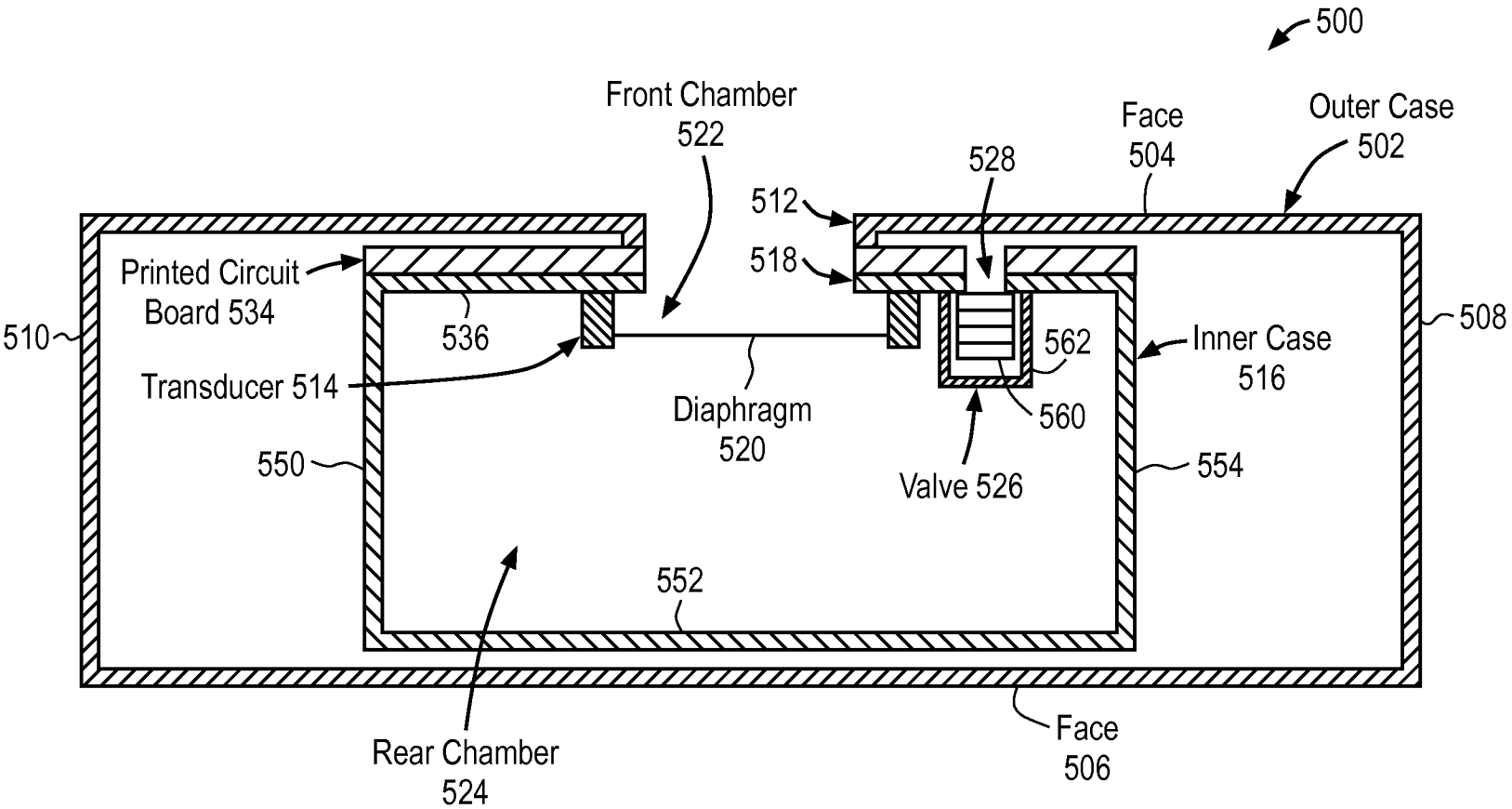
FIG. 5A illustrates a cross-sectional side view of another embodiment of a transducer having a valve to protect against a sudden air burst in a closed position.
Figure 5B:
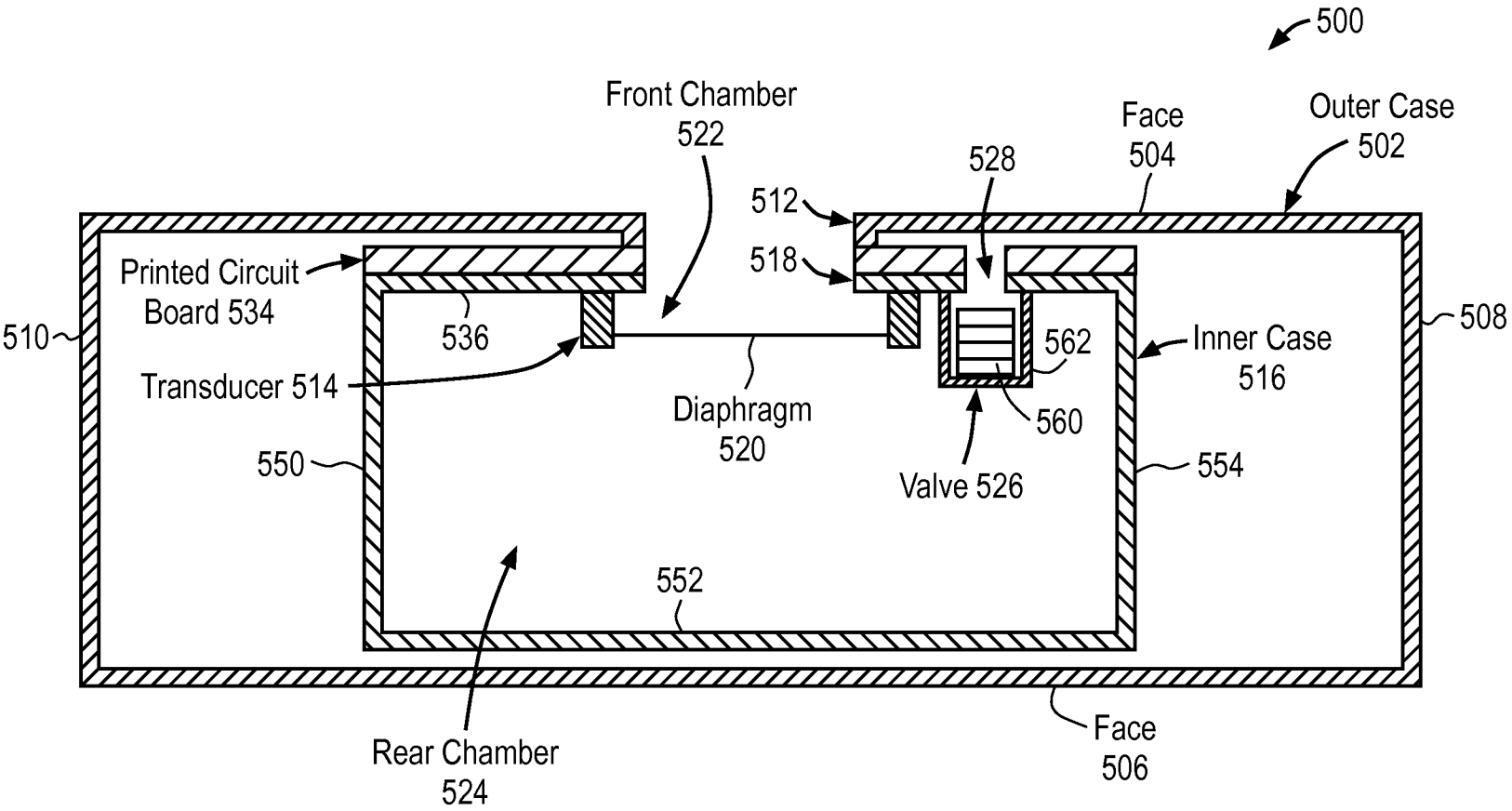
FIG. 5B illustrates a cross-sectional side view of the valve of FIG. 5A in an open position.

FIG. 5A and FIG. 5B illustrate cross-sectional side views of another embodiment of a valve for microphone protection. FIG. 5A illustrates the valve in a closed position and FIG. 5B illustrates the valve in an open position. Similar to the previously discussed electronic devices, electronic device 500 includes an outer case 502 dimensioned to contain the various components of the electronic device 500, such as transducer 514. Outer case 502 may include a face 504 (e.g., a front face), a face 506 (e.g., a back face) and side walls 508 and 510, which connect face 504 to face 506. Transducer 514 may be positioned within an inner case 516, mounted within outer case 502. In some embodiments, transducer 514 may be a microphone such as a MEMS microphone electrically connected to printed circuit board 534 to facilitate its operation. Representatively, transducer 514 may include a pressure-sensitive diaphragm 520 which vibrates in response to the externally generated sound waves. These vibrations are then converted into electrical current by transducer 514, which in turn become the audio signal (e.g., audio signal within a frequency range of from about 20 Hz to about 20 kHz) that can be transmitted to, for example, a far end user in the case of a mobile communications device or to a file such as the case with a video/audio recording. In this aspect, transducer 514 may include or be associated with processing components such as circuitry (which has been omitted for clarity) and may be electrically connected to printed circuit board 534 to facilitate its operation. Printed circuit board 534, along with transducer 514, may be contained within outer case 502. Inner case 516 may also have faces 536 and 552 which are connected by opposing side walls 550 and 554. Face 504 of outer case 502 may have an acoustic hole 512 aligned with an acoustic port 518 formed within face 536 of inner case 516.

Transducer 514 may be positioned near acoustic port 518 such that transducer 514 can receive sound from, or emit sound to, the ambient environment outside of device 500. Representatively, in one embodiment, diaphragm 520 of transducer 514 faces acoustic port 518 and acoustic hole 512. Diaphragm 520 may divide inner case 516 into a front chamber 522 which is acoustically coupled to one side of diaphragm 520 and a rear chamber 524, which is acoustically sealed from front chamber 522 and around a back side of diaphragm 520. In embodiments where transducer 514 is a microphone, a sound wave outside of device 500 (e.g., a user's voice) can travel through acoustic hole 512 and acoustic port 518 to transducer 514 where it can be received and converted to an audio signal for transmission to a far end user.

A relief port 528 may further be formed through inner case 516. Valve 526 is positioned near relief port 528 such that when valve 526 is in a closed position relief port 528 is covered by valve 526 and when valve 526 is in an open position, relief port 528 is uncovered. In one embodiment, relief port 528 is formed through a portion of inner case 516 defining the rear chamber 524. In this embodiment, valve 526 operates to reduce a pressure within rear chamber 524 when a pressure level rises due to an air burst traveling through acoustic port 518. In some embodiments, valve 526 may be an electrical-mechanical valve that opens and closes relief port 528 in response to a pressure change associated with diaphragm 520. Representatively, when a burst of air enters acoustic port 518, such as where device 500 unintentionally and forcefully collides with a flat surface or is cleaned with a high pressure air burst, the air burst applies a pressure on diaphragm 520, which in some cases, may be sufficient to damage diaphragm 520 as previously discussed. Valve 526 may therefore be configured to open in response to such a pressure on diaphragm 520, thus preventing any subsequent pressure increase within rear chamber 524 from reaching a level sufficient to damage diaphragm 520. Representatively, valve 526 may be made of a piezoelectric material that can deform and open relief port 528 in response to a predetermined threshold value corresponding to a pressure level sufficient to damage diaphragm. In this aspect, the piezoelectric material may be supported over relief port 528 using, for example a bracket assembly 562 sufficient to hold the material over relief port 528 while still allowing for deformation of the material. The valve 526 may be electrically coupled to a sensor associated with diaphragm 520 that can sense an acoustic signal produced by transducer 514, which corresponds to a pressure on diaphragm 520, or a pressure or force on diaphragm 520 directly. A predetermined threshold value, for example a threshold force value, is programmed into the device. In some cases the threshold value may be an acoustic signal that corresponds to an acoustic pressure greater than a sound pressure capable of being produced under normal circumstances, such as by a user's voice, but less than a pressure level that may cause damage to diaphragm. When a force or signal greater than or equal to the predetermined threshold value is detected by the sensor, an electrical current is supplied to the piezoelectric material of valve 526 (such as by associated circuitry, which is not shown) causing the material to deform (e.g., contract) such that relief port 528 is opened as illustrated by FIG. 5B. The pressure within rear chamber 524 can then be relieved through relief port 528. When the sensor detects that the acoustic signal has fallen below the threshold value, the electrical current is terminated such that the piezoelectric material of valve 526 returns to its resting, undeformed, state thereby closing relief port 528.

Figure 6A:
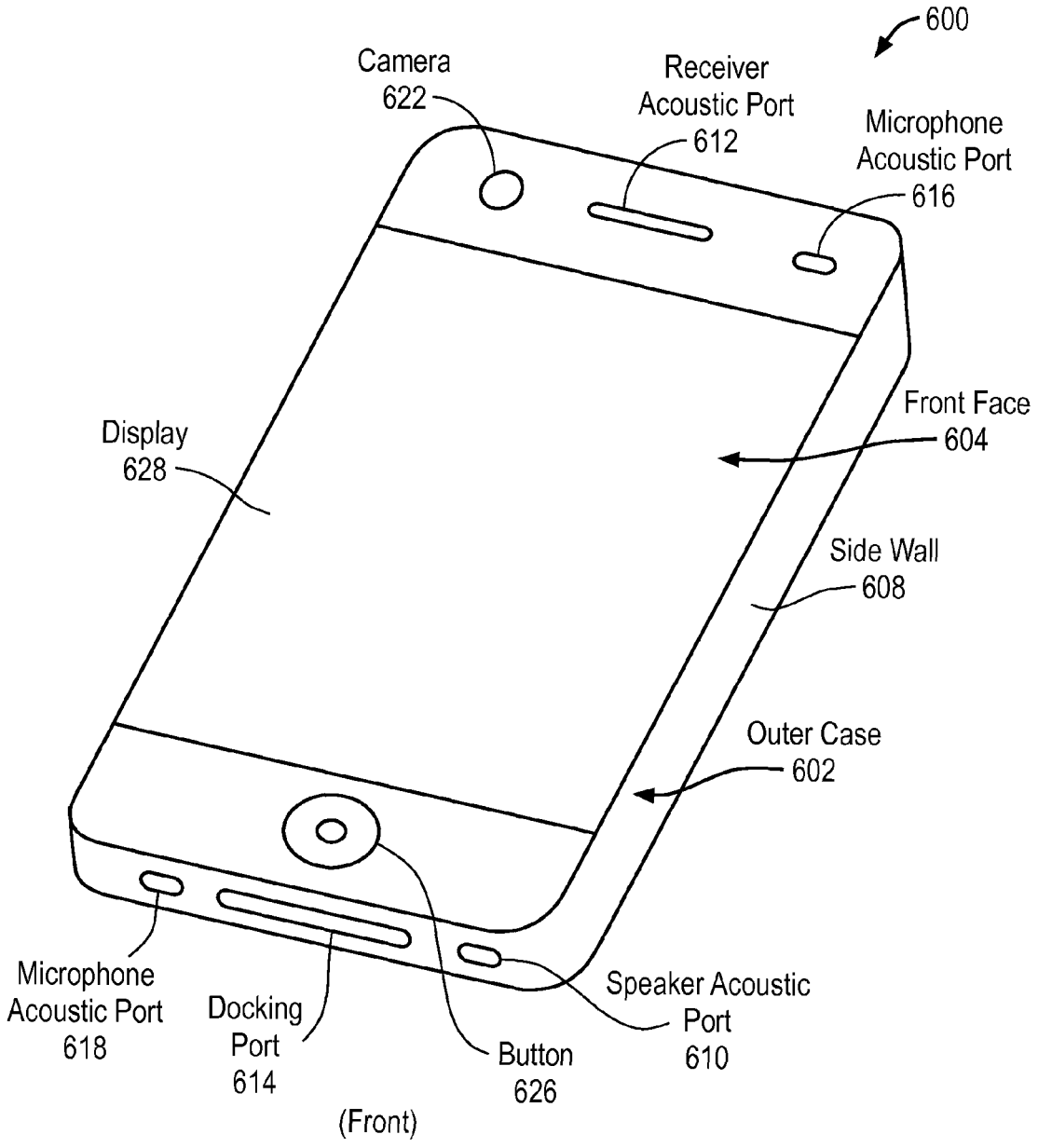
FIG. 6A illustrates a front perspective view of one embodiment of a portable electronic device within which a valve for transducer protection can be implemented.
Figure 6B:
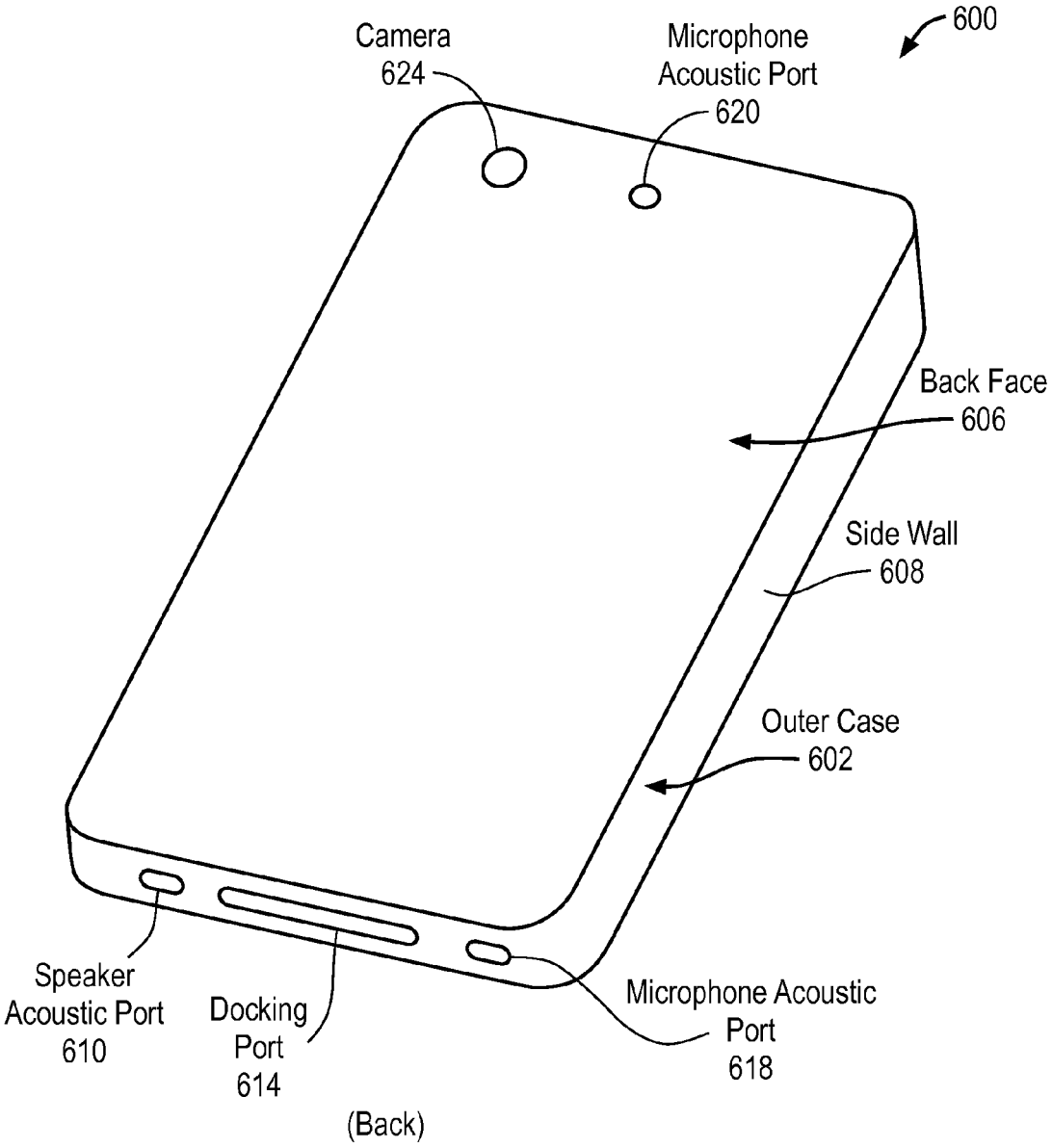
FIG. 6B illustrates a back perspective view of the portable electronic device of FIG. 6A.

FIG. 6A and FIG. 6B illustrate front and back perspective views of a portable electronic device 600, for example, a mobile communications device (also referred to as a wireless or mobile telephone), within which any of the above described valves may be implemented. Further details of the device 600 are given below in connection with the description of FIG. 7 and FIG. 8. For now, it should be appreciated that device 600 has an outer housing or case 602 defining or closing off a chamber in which the constituent electronic components of the device 600 are housed. Outer case 602 includes a substantially planar front face 604 and a substantially planar back face 606, which are connected by a sidewall portion 608. The face 604 may be considered a display side of the device in that it may include a touch screen display 628 that serves as an input and a display output for the device. The touch screen display 628 may be a touch sensor (e.g., those used in a typical touch screen display such as found in an iPhone® device by Apple Inc.). Although the touch screen is illustrated on front face 604, if desired, it may be mounted on the back face 606 of device 600, on a side wall 608 of device 600, on a flip-up portion of device 600 that is attached to a main body portion of device 600 by a hinge (for example), or using any other suitable mounting arrangement. The back face 606 may form a back side of the device, which can be held by the user during operation of device 600.

To further enable its use as a mobile communications device, device 600 may include various acoustic openings or ports at different locations within outer case 602 to allow for transmission of acoustic signals to and from device 600. Representatively, outer case 602 may have formed therein a speaker acoustic port 610, a receiver acoustic port 612 and microphone acoustic ports 616, 618, 620. Although the acoustic ports are illustrated as separate ports, it is contemplated that any one or more of the illustrated ports may be combined into one port such that, for example, the transducers associated with the illustrated receiver or microphone ports may instead share the same port. In one embodiment, the receiver acoustic port 612 is formed within front face 604 of outer case 602 and speaker acoustic port 610 is formed within an end portion of sidewall 608. It is contemplated, however, that each of these ports may be formed in other portions of outer case 602, for example, speaker acoustic port 610 may be on the front face 604 or back face 606 while receiver acoustic port 610 is along the sidewall. Each of these ports may consist of multiple holes clustered together or alternatively a single, large hole as shown.

Microphone acoustic ports 616, 618 and 620 may be formed along the front face 604, back face 606 and sidewall 608 of outer case 602 as illustrated. Representatively, in one embodiment, microphone acoustic port 616 is formed in front face 604 while microphone acoustic port 620 is formed in back face 606. Microphone acoustic port 618 may be formed within a bottom portion of sidewall 608. Although FIG. 6A and FIG. 6B illustrate a single microphone acoustic port formed within each of the above described portions of outer case 602, it is contemplated that more than one microphone acoustic port may be formed in one or more of these portions. For example, two microphone acoustic ports may be formed along front face 604 or back face 606.

Each of the speaker acoustic port 610, receiver acoustic port 612 and microphone acoustic ports 616, 618 and 620 may be associated with one or more of the previously discussed transducers, which are mounted within outer case 602. In the case of the microphone acoustic ports 616, 618 and 620, the transducer is an acoustic-to-electric transducer such as a microphone that converts sound into an electrical signal. The microphone may be any type of microphone capable of receiving acoustic energy, for example sound through the associated port, and converting it into an electrical signal. For example, in one embodiment, the microphone may be MEMS microphone, also referred to as a microphone chip or silicon microphone. In this aspect, various features of the microphone such as the pressure-sensitive diaphragm and in some cases a protective valve as previously discussed, are etched directly into a silicon chip by MEMS techniques.

The MEMS microphone components, including the pressure-sensitive diaphragm, while sensitive to acoustic pressures, may also be sensitive to sudden acoustic shocks such as high pressure, impulsive air bursts as previously discussed. Such an air burst may occur when, for example, device 600 collides forcefully with a substantially flat surface or a user tries to clean the device with a compressed air duster. A pressure from such an air burst is particularly problematic with respect to microphones associated with ports on the substantially planar faces (e.g., front face 604 and back face 606) of device 600. In order to protect the MEMS microphone, particularly the diaphragm, from such air bursts, any of the previously described valves may be co-located near the diaphragm within a shared sealed volume so that the burst of high pressure follows the path of least resistance, i.e., through the opened valve as previously discussed.

Cameras 622, 624 may further be mounted to outer case 602 to capture still and/or video images of objects of interest. In the illustrated embodiment, cameras 622, 624 are mounted along the front face 604 and back face 606 of outer case 602, respectively. It is contemplated, however, that in some embodiments, cameras 622, 624 may be mounted along the same side or face of outer case 602, or one of cameras 622, 624 may be omitted such that a camera is mounted on only one side of outer case 602.

The outer case 602 may further include other input-output devices such as an earphone port (not shown) to receive an earphone plug, docking port 614 and command button 626. Docking port 614 may sometimes be referred to as a dock connector, 30-pin data port connector, input-output port, or bus connector, and may be used as an input-output port (e.g., when connecting device 600 to a mating dock connected to a computer or other electronic device). Command button 626 may be, for example, a menu button or any other device that can be used to supply an input to and/or operate device 600.

Figure 7:
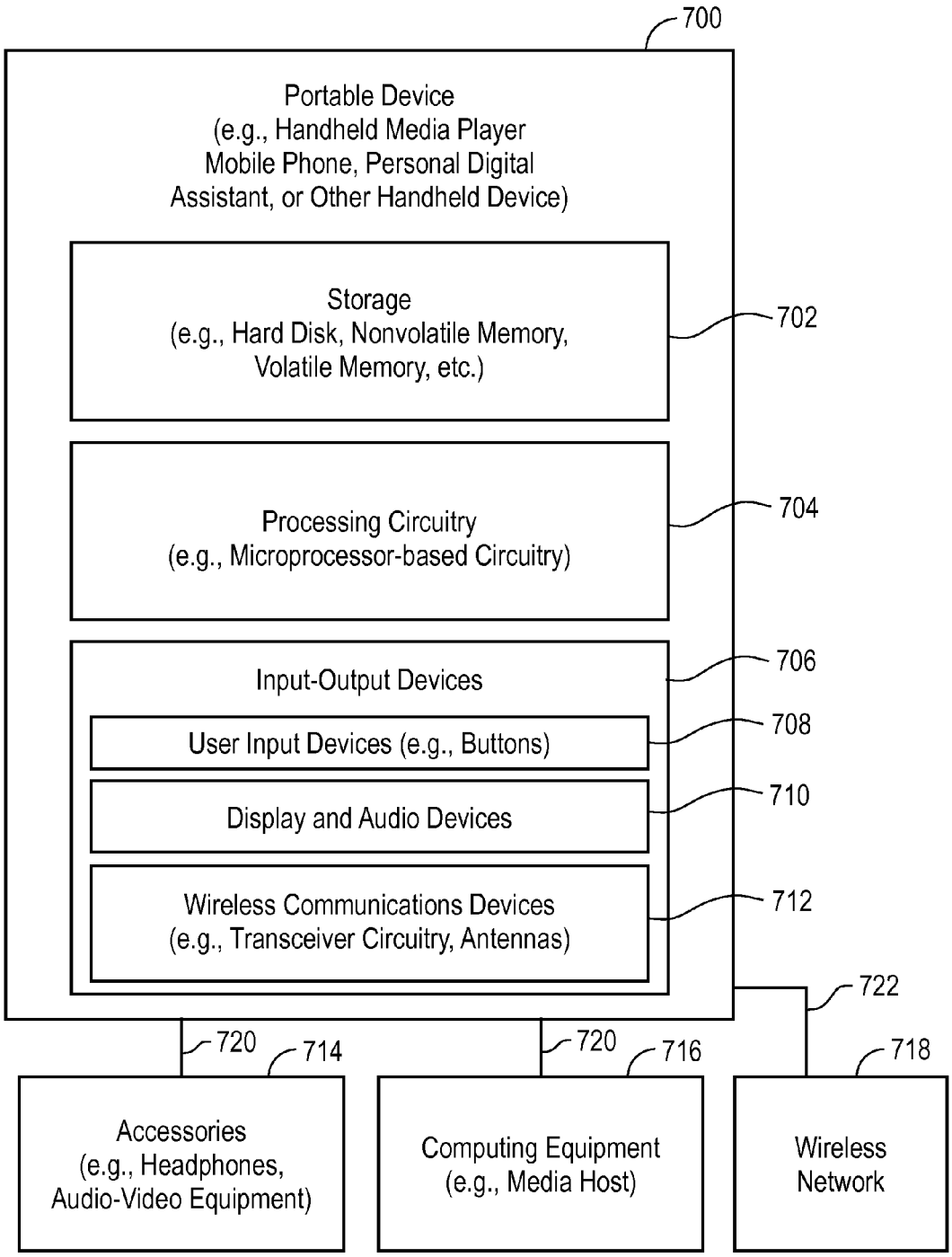
FIG. 7 illustrates a schematic diagram of one embodiment of a portable electronic device.

FIG. 7 illustrates a block diagram of one embodiment of an electronic device within which any of the previously discussed valves may be implemented. As shown in FIG. 7, device 700 may include storage 702. Storage 702 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 704 may be used to control the operation of device 700. Processing circuitry 704 may be based on a processor such as a microprocessor and other suitable integrated circuits. With one suitable arrangement, processing circuitry 704 and storage 702 are used to run software on device 700, such as internet browsing applications, voice-over-internet-protocol (VOIP) telephone call applications, email applications, media playback applications, operating system functions, etc. Processing circuitry 704 and storage 702 may be used in implementing suitable communications protocols. Communications protocols that may be implemented using processing circuitry 704 and storage 702 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 704 may include power management circuitry to implement power management functions. For example, processing circuitry 704 may be used to adjust the gain settings of amplifiers (e.g., radio-frequency power amplifier circuitry) on device 700. Processing circuitry 704 may also be used to adjust the power supply voltages that are provided to portions of the circuitry on device 700. For example, higher direct-current (DC) power supply voltages may be supplied to active circuits and lower DC power supply voltages may be supplied to circuits that are less active or that are inactive. If desired, processing circuitry 704 may be used to implement a control scheme in which the power amplifier circuitry is adjusted to accommodate transmission power level requests received from a wireless network.

Input-output devices 708 may be used to allow data to be supplied to device 700 and to allow data to be provided from device 700 to external devices. Display screen 628, button 626, microphone acoustic ports 616, 618 and 620, speaker acoustic port 610, and docking port 614 are examples of input-output devices 708.

Input-output devices 708 can also include user input-output devices 706 such as buttons, touch screens, joysticks, click wheels, scrolling wheels, touch pads, key pads, keyboards, microphones, cameras, etc. A user can control the operation of device 700 by supplying commands through user input devices 706. Display and audio devices 710 may include liquid-crystal display (LCD) screens or other screens, light-emitting diodes (LEDs), and other components that present visual information and status data. Display and audio devices 710 may also include audio equipment such as speakers and other devices for creating sound. Display and audio devices 710 may contain audio-video interface equipment such as jacks and other connectors for external headphones and monitors.

Wireless communications devices 712 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of microphone acoustic ports 616, 618 and 620, one or more of transducers 114, 414 or 514 associated with these ports may be in communication with an RF antenna for transmission of signals from the transducer to a far end user. Such a configuration is illustrated in more detail in FIG. 8.

Figure 8:
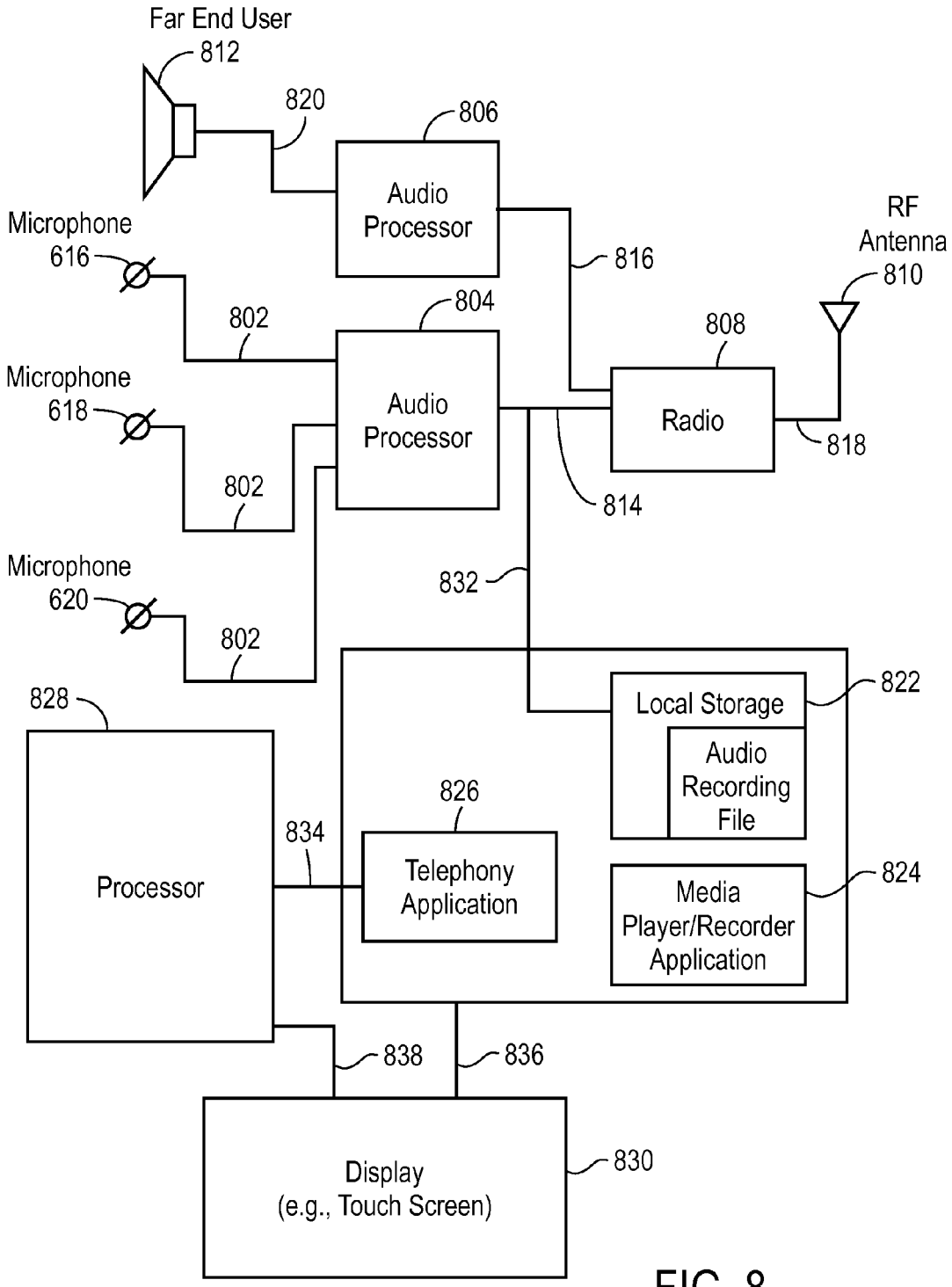
FIG. 8 illustrates a schematic diagram of one embodiment of a portable electronic device.

For example, FIG. 8 illustrates an embodiment in which each microphone 616, 618, 620 may be in communication with an audio processor 804 through paths 802. Paths 802 may include wired and wireless paths. Signals from microphones 616, 618, 620 may be transmitted through uplink audio signal path 814 to radio 808. Radio 808 may transmit the signals via downlink audio signal path 816 to audio processor 806, which is in communication with a far end user device 812 through path 820. Alternatively, radio 808 may transmit the signals to RF antenna 810 through path 818. Audio processor 804 may also be in communication with local storage 822, a media player/recorder application 824 or other telephony applications 826 on the device, through path 832, for local storage and/or recording of the audio signals as desired. Processor 828 may further be in communication with these local devices via path 834 and also display 830 via path 838 to facilitate processing and display of information corresponding to the audio signals to the user. Display 830 may also be in direction communication with local storage 822 and applications 824, 826 via path 836 as illustrated.

Returning to FIG. 7, device 700 can communicate with external devices such as accessories 714, computing equipment 716, and wireless network 718 as shown by paths 720 and 722. Paths 720 may include wired and wireless paths. Path 722 may be a wireless path. Accessories 714 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 716 may be any suitable computer. With one suitable arrangement, computing equipment 716 is a computer that has an associated wireless access point (router) or an internal or external wireless card that establishes a wireless connection with device 700. The computer may be a server (e.g., an internet server), a local area network computer with or without internet access, a user's own personal computer, a peer device (e.g., another portable electronic device 700), or any other suitable computing equipment.

Wireless network 718 may include any suitable network equipment, such as cellular telephone base stations, cellular towers, wireless data networks, computers associated with wireless networks, etc. For example, wireless network 718 may include network management equipment that monitors the wireless signal strength of the wireless handsets (cellular telephones, handheld computing devices, etc.) that are in communication with network 718.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, any type of valve capable of reducing an impact of an incoming air burst on a transducer may be used, such as a one-way valve system which allows air to exit the relief port to the outer case but does not allow air entry. Still further, although a portable electronic device such as a mobile communications device is described herein, any of the previously discussed valve and transducer configurations may be implemented within a tablet computer, personal computer, laptop computer, notebook computer and the like. The description is thus to be regarded as illustrative instead of limiting.

What is claimed is:

1. A portable electronic device comprising:

an outer case having a wall in which a transducer-associated acoustic hole is formed;

an inner case positioned inside the outer case, the inner case having an acoustic port that opens to the transducer-associated acoustic hole and a relief port that opens to the outer case;

a micro-electro-mechanical systems (MEMS) microphone having a diaphragm facing the acoustic port of the inner case, the microphone being mounted within the inner case; and a valve positioned over the relief port, wherein the valve is operable to open the relief port in response to an incoming air burst through the acoustic port to protect the microphone against the incoming air burst.

2. The portable electronic device of claim 1 wherein the diaphragm divides the inner case into a front chamber acoustically coupled to the acoustic port and a rear chamber, wherein the front chamber is substantially acoustically sealed from the rear chamber.

3. The portable electronic device of claim 2 wherein the relief port is formed within the rear chamber.

4. The portable electronic device of claim 2 wherein the relief port is formed within the front chamber.

5. The portable electronic device of claim 1 wherein the valve is a pressure sensitive valve operable to transition between a closed position and an open position when a pressure changes within the inner case.

6. The portable electronic device of claim 1 wherein the valve is a piezoelectric valve operable to transition between a closed position and an open position when a pressure on the diaphragm changes.

7. A portable electronic device comprising:

an outer case having a wall in which a microphone-associated acoustic hole is formed;

an inner case located inside the outer case, the inner case having a front chamber and a rear chamber substantially acoustically sealed from the front chamber, wherein the front chamber comprises an acoustic port aligned with the microphone-associated acoustic hole and a relief port;

a micro-electro-mechanical systems (MEMS) microphone having a diaphragm facing the acoustic port of the inner case, the microphone being mounted within the rear chamber; and a pressure sensitive valve positioned over the relief port, wherein the pressure sensitive valve transitions between a closed position and an open position in response to an incoming air burst such that in the open position, an impact of the air burst is diverted from the diaphragm to the relief port, and wherein the pressure sensitive valve transitions to the open position in response to a threshold pressure at least two times higher than standard atmospheric pressure.

8. The portable electronic device of claim 7 wherein the acoustic port is formed along a face of the inner case and the relief port is formed along a side wall of the inner case.

9. The portable electronic device of claim 7 wherein the pressure sensitive valve is integrally formed as part of the microphone.

10. A portable electronic device comprising:

an outer case having a wall in which a microphone-associated acoustic hole is formed;

an inner case located inside the outer case, the inner case having a front chamber and a rear chamber substantially acoustically sealed from the front chamber, wherein the front chamber comprises an acoustic port aligned with the microphone-associated acoustic hole and the rear chamber comprises a relief port;

a microphone having a diaphragm facing the acoustic port of the inner case, the microphone being mounted between the front chamber and the rear chamber; and a valve associated with the relief port, wherein the valve is a piezoelectric valve operable to deform to open the relief port when a pressure change on the diaphragm corresponds to a predetermined threshold pressure and modify a pressure within the rear chamber.

11. The portable electronic device of claim 10 wherein the relief port is formed within a wall of the inner case opposite the microphone-associated acoustic hole.

12. The portable electronic device of claim 10 wherein the relief port is formed within a side wall of the inner case.

* * * * *